US010828902B2

(12) United States Patent
Sasaki et al.

(10) Patent No.: US 10,828,902 B2
(45) Date of Patent: Nov. 10, 2020

(54) LIQUID EJECTION APPARATUS AND CONTROL METHOD FOR THE LIQUID EJECTION APPARATUS WHERE A LIQUID EJECTION UNIT AND CAP MEMBER ARE SEPARATED WITH A NEGATIVE PRESSURE STATE IN A SPACE THEREBETWEEN UNDER CERTAIN CONDITIONS

(71) Applicant: CANON KABUSHIKI KAISHA, Tokyo (JP)

(72) Inventors: Takashi Sasaki, Yokohama (JP); Noriko Sato, Kawasaki (JP); Takahiro Kiuchi, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/356,291

(22) Filed: Mar. 18, 2019

(65) Prior Publication Data

US 2019/0291438 A1 Sep. 26, 2019

(30) Foreign Application Priority Data

Mar. 22, 2018 (JP) ..... 2018-054638

(51) Int. Cl.
*B41J 2/165* (2006.01)

(52) U.S. Cl.
CPC ..... *B41J 2/1652* (2013.01); *B41J 2/16505* (2013.01)

(58) Field of Classification Search
CPC .. B41J 2/1652; B41J 2/16505; B41J 2/16508; B41J 2/16532; B41J 2/16538; B41J 2/16588
See application file for complete search history.

(56) References Cited

U.S. PATENT DOCUMENTS

| | | | | |
|---|---|---|---|---|
| 7,150,519 | B2 | 12/2006 | Kono et al. | |
| 2008/0143778 | A1* | 6/2008 | Sugiyama | B41J 2/16508 347/23 |
| 2009/0153611 | A1 | 6/2009 | Shimizu et al. | |
| 2018/0311960 | A1 | 11/2018 | Nakai et al. | |
| 2018/0311961 | A1 | 11/2018 | Kiuchi et al. | |
| 2019/0009522 | A1 | 1/2019 | Fukasawa et al. | |
| 2019/0009547 | A1 | 1/2019 | Sasaki et al. | |
| 2019/0009548 | A1 | 1/2019 | Sato et al. | |
| 2019/0009553 | A1 | 1/2019 | Nakai et al. | |

FOREIGN PATENT DOCUMENTS

| | | |
|---|---|---|
| JP | 2009-143155 | 7/2009 |

* cited by examiner

*Primary Examiner* — Henok D Legesse
(74) *Attorney, Agent, or Firm* — Venable LLP

(57) ABSTRACT

A liquid ejection apparatus includes a cap member contacting an ejection opening surface of a liquid ejection unit and covering the ejection opening surface, and a drive motor configured to cause the ejection opening surface and the cap member to contact or separate from each other. Furthermore, the liquid ejection apparatus includes a negative pressure generation unit configured to bring a space surrounded by the ejection opening surface and the cap member into a negative pressure state, and a control unit configured to drive the negative pressure generation unit to bring the space into a negative pressure state under a separation instruction to separate the cap member and the liquid ejection unit, and subsequently cause the drive motor to separate the liquid ejection unit and the cap member.

15 Claims, 17 Drawing Sheets

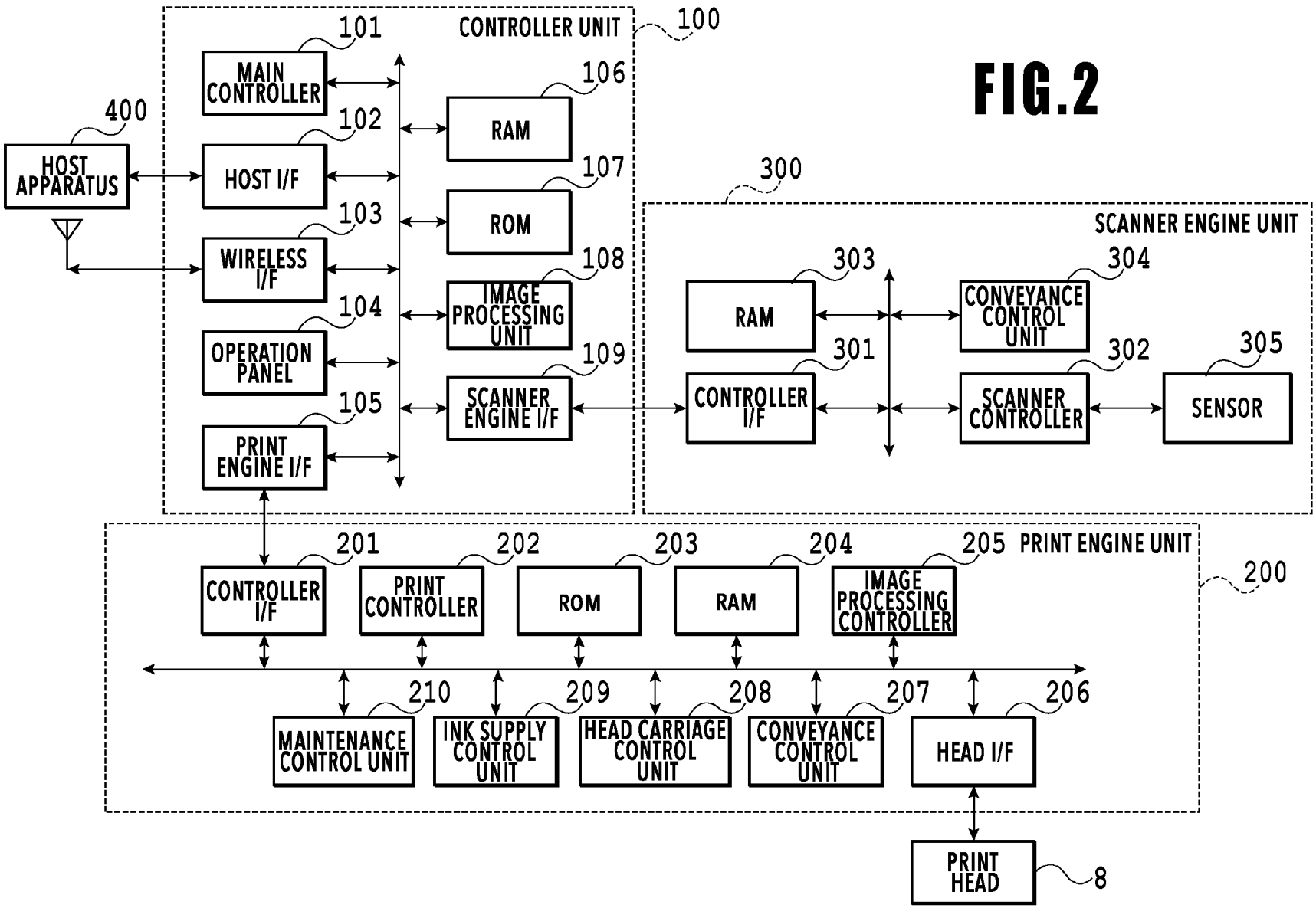
FIG.2
CONTROLLER UNIT
100
MAIN CONTROLLER
101
HOST I/F
102
WIRELESS I/F
103
OPERATION PANEL
104
PRINT ENGINE I/F
105
RAM
106
ROM
107
IMAGE PROCESSING UNIT
108
SCANNER ENGINE I/F
109
HOST APPARATUS
400
SCANNER ENGINE UNIT
300
CONVEYANCE CONTROL UNIT
304
SCANNER CONTROLLER
302
SENSOR
305
RAM
303
CONTROLLER I/F
301
PRINT ENGINE UNIT
200
CONTROLLER I/F
201
PRINT CONTROLLER
202
ROM
203
RAM
204
IMAGE PROCESSING CONTROLLER
205
HEAD I/F
206
CONVEYANCE CONTROL UNIT
207
HEAD CARRIAGE CONTROL UNIT
208
INK SUPPLY CONTROL UNIT
209
MAINTENANCE CONTROL UNIT
210
PRINT HEAD
8

LIQUID EJECTION APPARATUS AND CONTROL METHOD FOR THE LIQUID EJECTION APPARATUS WHERE A LIQUID EJECTION UNIT AND CAP MEMBER ARE SEPARATED WITH A NEGATIVE PRESSURE STATE IN A SPACE THEREBETWEEN UNDER CERTAIN CONDITIONS

BACKGROUND OF THE INVENTION

Field of the Invention

The present invention relates to a liquid ejection apparatus including (i) a liquid ejection unit configured to eject liquid from ejection openings and (ii) cap members for covering the ejection openings. The present invention also relates to control method for the liquid ejection apparatus.

DESCRIPTION OF THE RELATED ART

Japanese Patent Laid-Open No. 2009-143155 has disclosed therein a technique of reciprocally moving a carriage holding a print head by a very small amount in the case where driving a movement unit configured to separate a cap member from the print head fails to separate the cap member from the print head.

However, in a state that the cap member is firmly fixed to the print head, causing the carriage to reciprocally move by a very small amount as described in Japanese Patent Laid-Open No. 2009-143155 may not dissolve the firmly fixed state between the cap member and the print head.

SUMMARY OF THE INVENTION

It is an object of the present invention to provide a liquid ejection apparatus capable of reliably separating a cap member from a liquid ejection unit, and a control method of the liquid ejection apparatus.

In one aspect, present invention relates to a liquid ejection a apparatus. The liquid ejection apparatus includes a liquid ejection unit, a cap, a drive motor, a negative pressure generation unit, and a control unit. The liquid ejection unit has an ejection opening surface with an ejection opening for ejecting liquid formed thereon. The cap member contacts the ejection opening surface and covers the ejection opening surface. The drive motor is configured to cause the liquid ejection unit and the cap member to contact or separate from each other. The negative pressure generation unit is configured to bring a space surrounded by the ejection opening surface and the cap member into a negative pressure state, state. The control unit is configured to drive the negative pressure generation unit to bring the space into a negative pressure state and subsequently cause the drive motor to separate the liquid ejection unit and the cap member under a separation instruction to separate the cap member and the liquid ejection unit.

Further features of the present invention will become apparent from the following description of exemplary embodiments with reference to the attached drawings.

BRIEF DESCRIPTION OF THE DRAWINGS

FIG. 2 is a block diagram showing a control system in a printing apparatus;

DESCRIPTION OF THE EMBODIMENTS

First Embodiment

In the following, embodiments of a liquid ejection apparatus according to the present invention will be described. Note that, in the embodiments described later, the liquid ejection apparatus will be described taking, as an example, an inkjet printing apparatus including liquid ejection units (print head) configured to eject liquid (ink) including colorants.

Figure 1:
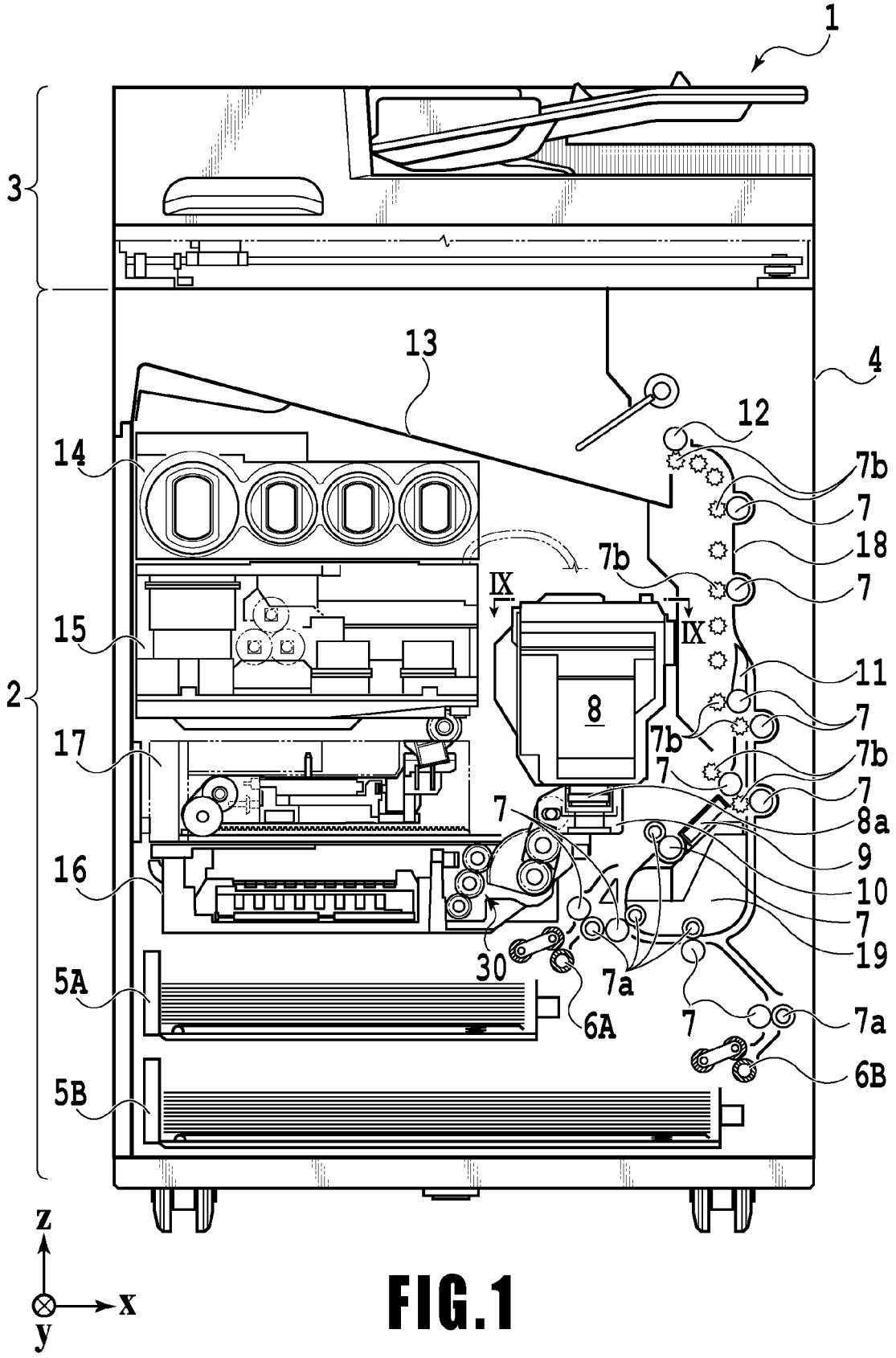
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing print medium (cut sheets) S are detachably provided at the bottom of a casing 4 in the vertical direction.

A relatively small print medium of up to A4 size is stacked and housed in the first cassette 5A and a relatively large print medium of up to A3 size is placed flat and housed in the second cassette 5B. A first feeding unit 6A for feeding a housed print medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing print mediums S that were subjected to print operation and discharged by the discharging roller 12.

The print head 8 of the present embodiment is a full line type color inkjet print head, with a plurality of ejection openings configured to eject ink based on print data being arrayed in the y-direction in FIG. 1 so as to correspond to the maximum width of a print medium S to be used. In the case where the print head 8 is in a standby position, an ejection opening surface 8*a* of the print head 8 is in a state oriented vertically downward as shown in FIG. 1, with the periphery of the ejection openings being covered (capped) with a cap member 120 (FIG. 8A) provided on a cap unit 10 described later. When performing print operation, the orientation of the print head 8 is changed by a print controller (control unit) 202 described later such that the ejection opening surface 8*a* faces a platen 9. The platen 9 includes a flat plate extending in the y-direction and supports, from the back side, the print medium S to be subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 is intended to perform maintenance/recovery (maintenance) of the ejection performance of the ejection openings provided in the print head, and includes the cap unit 10 and a wiping unit 17. The maintenance unit 16 performs maintenance operation for the print head 8 by activating the units at predetermined timings. The maintenance operation will be described in detail later.

FIG. 2 is a block diagram showing a control system in the printing apparatus 1. The control system mainly includes a print engine unit 200 that exercises control over the print unit 2, a scanner engine unit 300 that exercises control over the scanner unit 3, and a controller unit 100 that exercises control over the entire printing apparatus 1. A print controller 202 functions as a control unit configured to control various mechanisms of the print engine unit 200 under instructions from a main controller 101 of the controller unit 100. Various mechanisms of the scanner engine unit 300 are controlled by the main controller 101 of the controller unit 100. The control system will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 by controlling a head movement mechanism (relative movement unit) in accordance with an operating state of the printing apparatus 1 such as a maintenance state or a printing state to thereby change the orientation or the angle of the print head 8 so as to move it to the standby position and to the printing position. Note that the head movement mechanism includes a drive motor (not shown) controlled by the print controller 202, and a power conversion mechanism configured to convert the driving force of the drive motor into operation of changing the orientation (angle) of the head unit holding the print head 8 and movement operation along the vertical direction.

An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
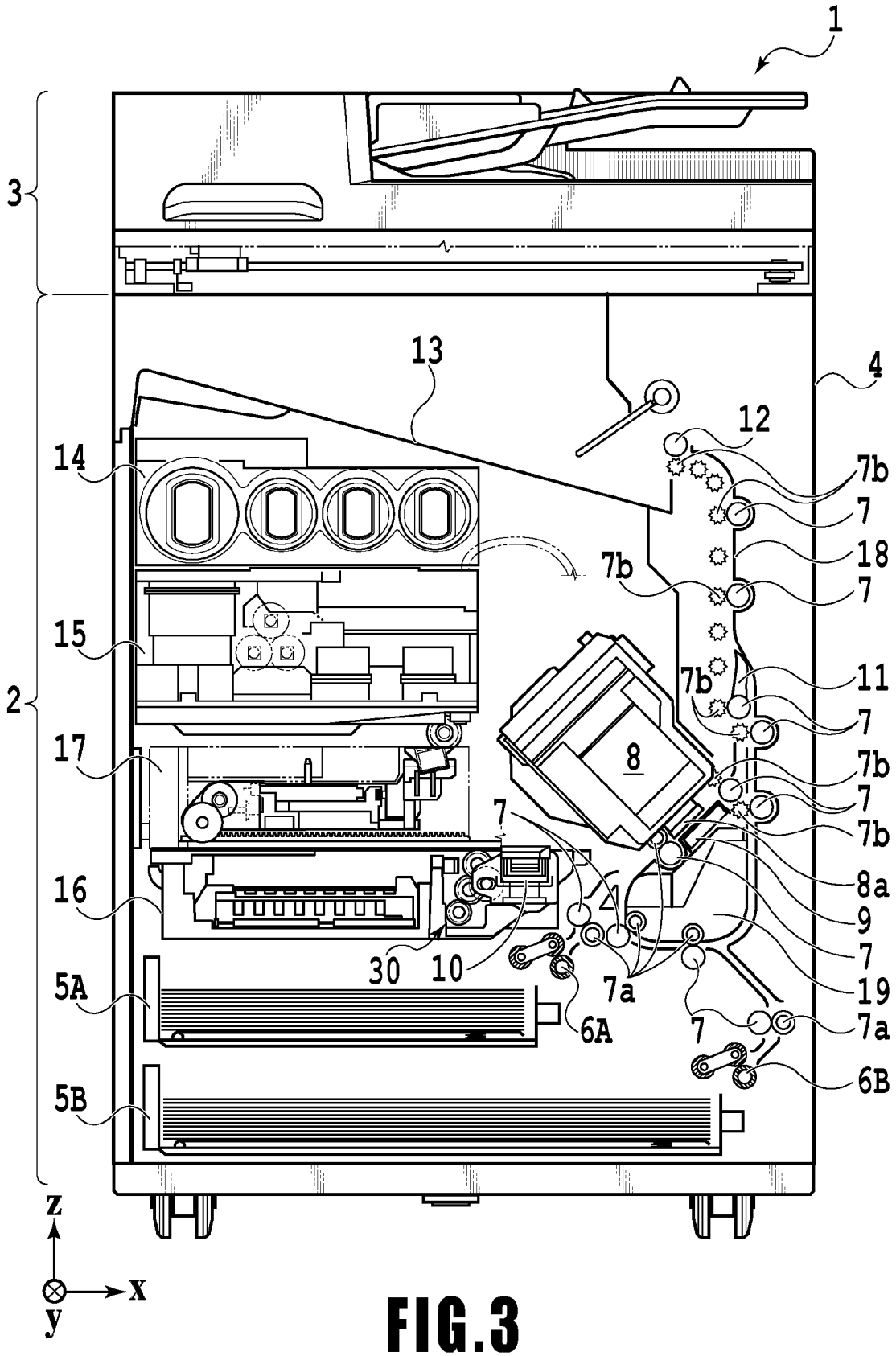
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

When moving the print head 8 from the standby position shown in FIG. 1 to the printing position shown in FIG. 3, the print controller 202 uses the maintenance control unit 210 to activate an ascending and descending mechanism (separating operation unit) described later, and lowers the cap unit 10 to an evacuation position shown in FIG. 3. As a result, the ejection opening surface 8*a* of the print head 8 is separated from the cap member 120. Subsequently, the print controller 202 uses the head carriage control unit 208 to turn the print head 8 by an angle of 45° while adjusting the vertical height of the print head 8, such that the ejection opening surface 8*a* faces the platen 9. When the print head 8 moves from the printing position to the standby position upon completion of the print operation, the print controller 202 performs a process reversed to that described above.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
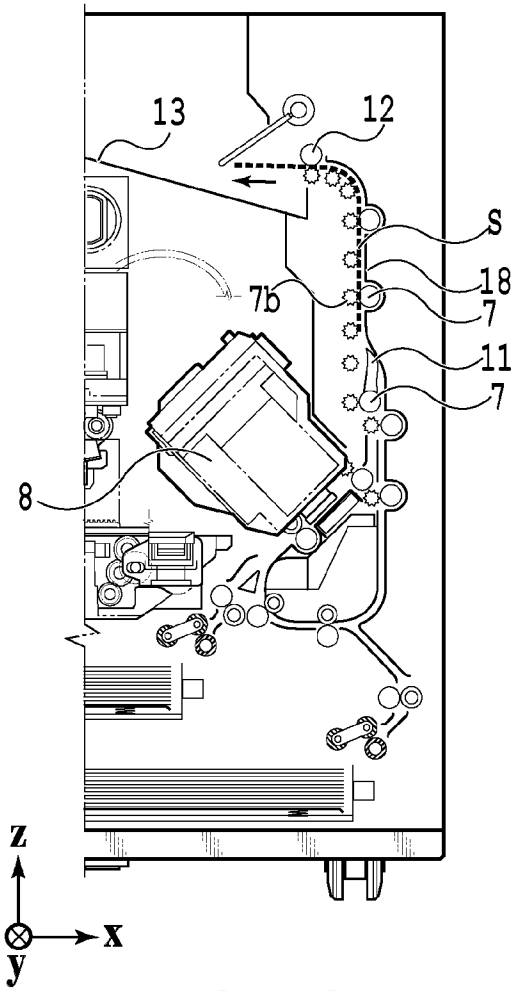
FIGS. 4A to 4C are conveying path diagrams of a print medium fed from a first cassette.
Figure 4B:
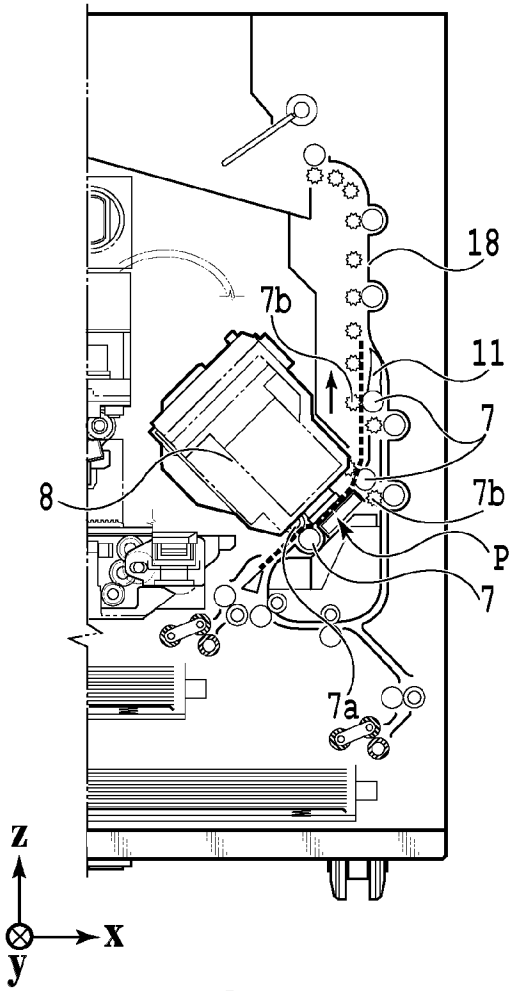
Figure 4A:
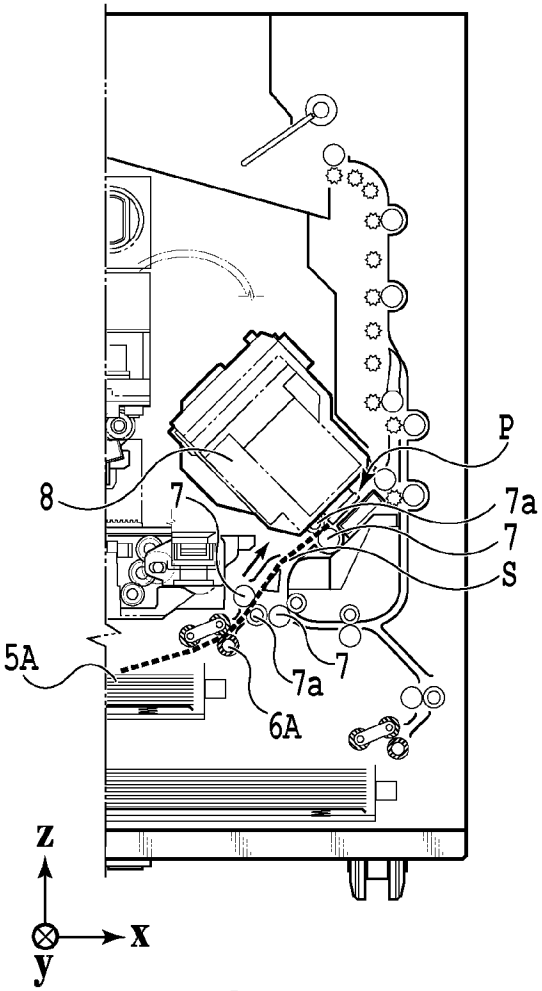

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
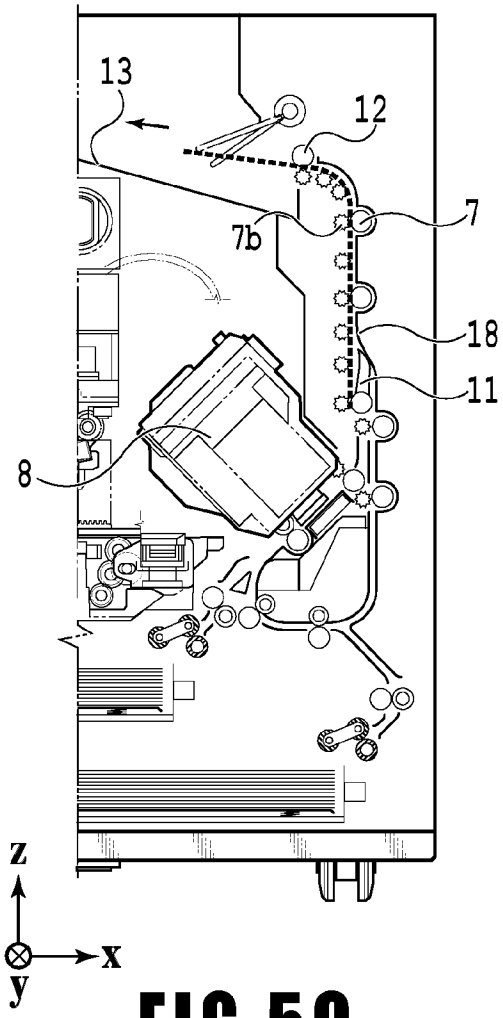
FIGS. 5A to 5C are conveying path diagrams of a print medium fed from a second cassette.
Figure 5B:
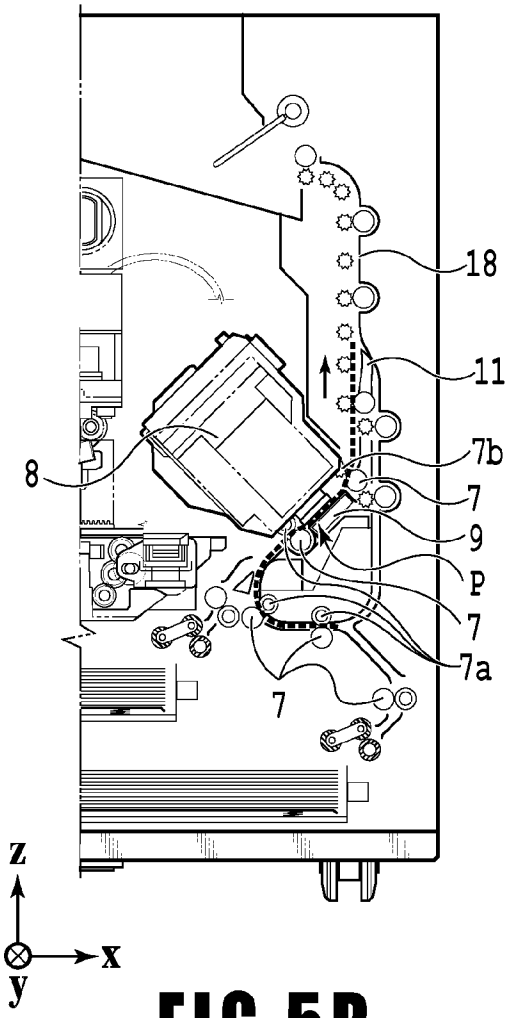
Figure 5A:
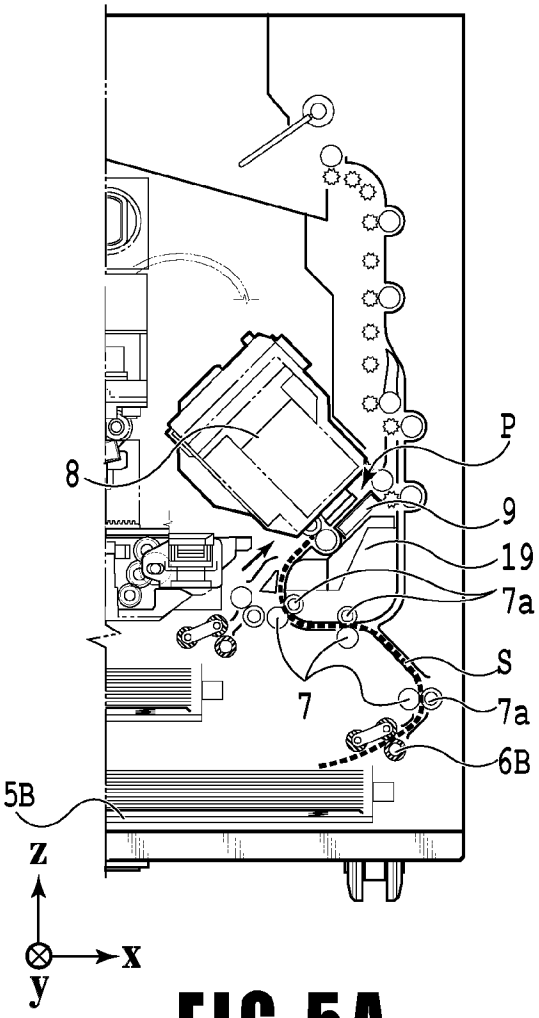

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
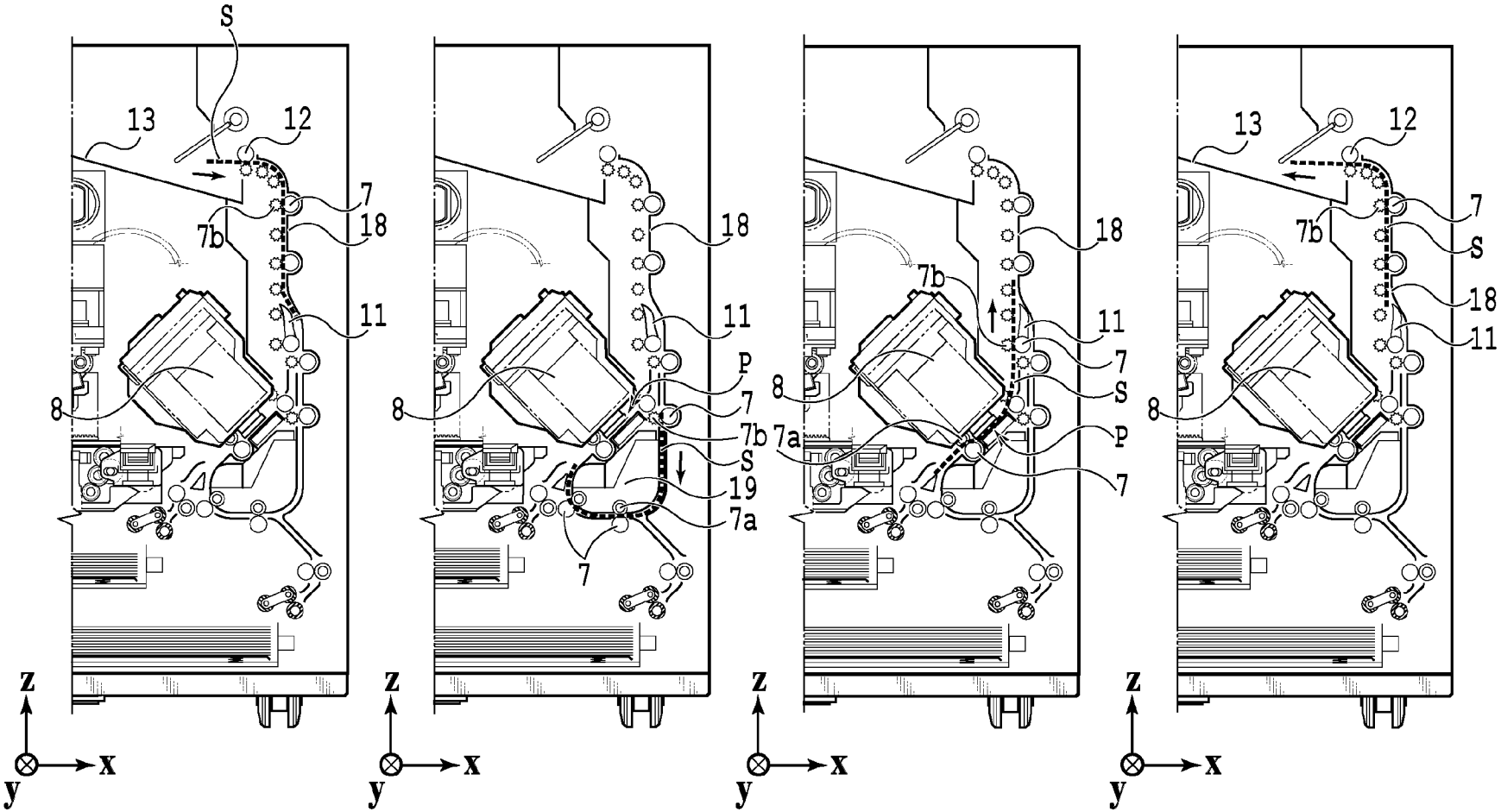
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, recovery operation (maintenance operation) performed to maintain and recover the ejection property of the ejection openings provided in the print head 8 will be described. As described with reference to FIG. 1, the maintenance unit 16 of the present embodiment includes the cap unit 10 and the wiping unit 17 and activates them at predetermined timings to perform maintenance operation.

Figure 7:
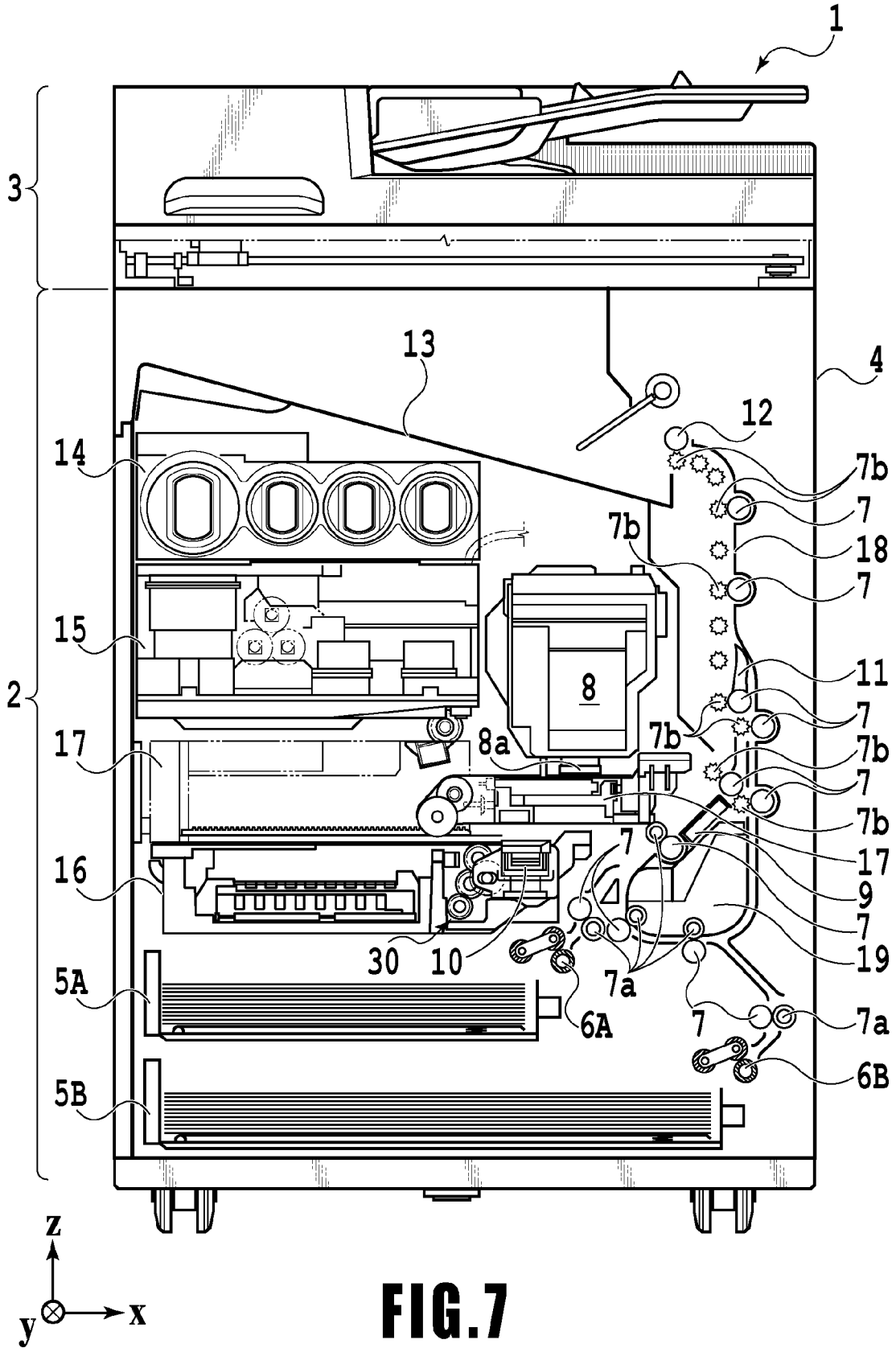
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
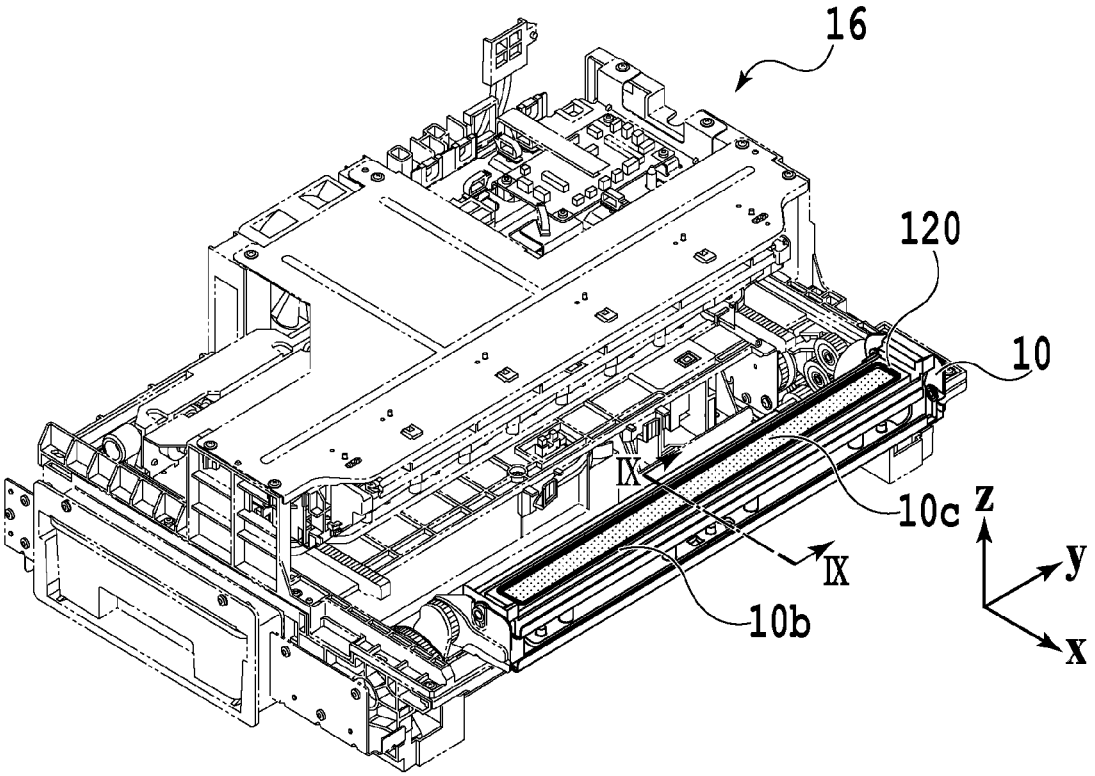
FIGS. 8A and 8B are perspective views showing the configuration of a maintenance unit.
Figure 8B:
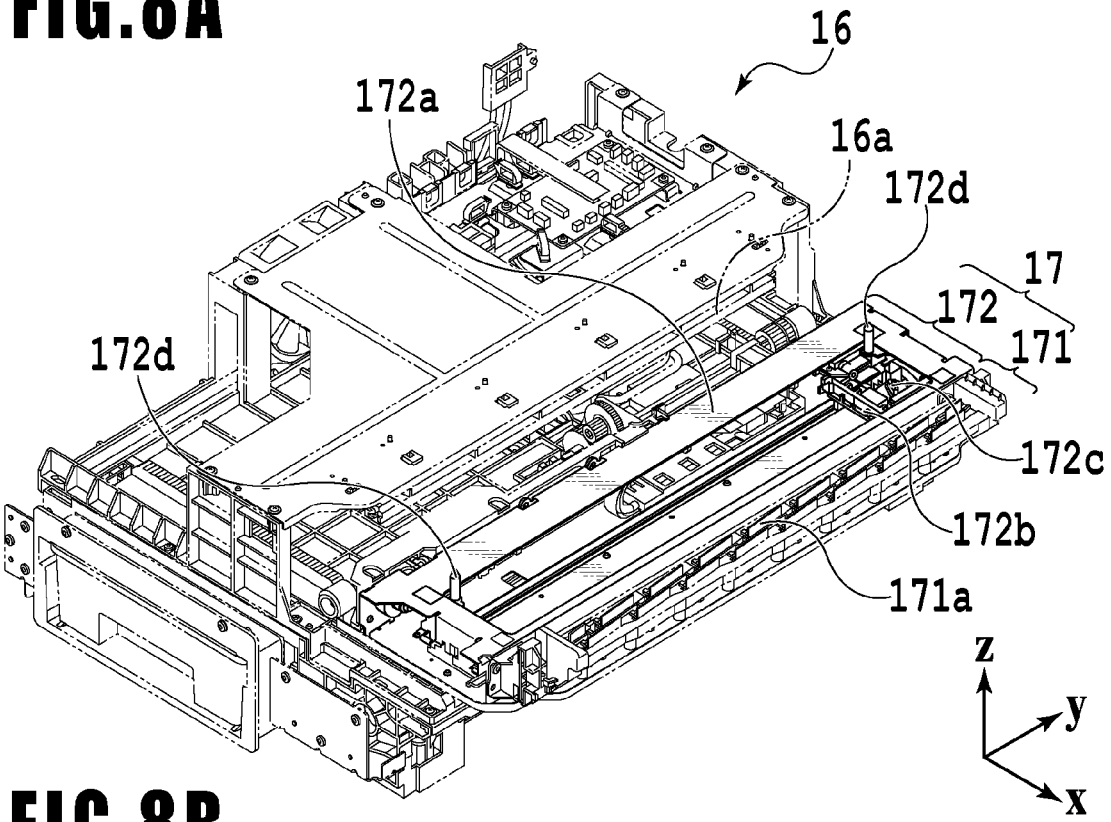

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. In the case where the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 has a cap member 120 capable of covering (capping) the ejection openings of the print head, the interior of the cap member 120 has provided therein an ink absorber (liquid absorber) 131 for absorbing ink discharged from the print head 8. The cap unit 10 will be described in detail later.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

The blade wiper unit 171 is intended to wipe off the ink adhering to the ejection opening surface 8*a* by moving (causing to wipe), in the x-direction, a blade wiper 171*a* provided in the y-direction, by a length corresponding to the area in which the ejection openings are arrayed.

In addition, the vacuum wiper unit 172 includes a flat plate 172*a* having an opening extending in the y-direction, a carriage 172*b* movable in the y-direction within the opening, and a vacuum wiper 172*c* mounted on the carriage 172*b*. The tip of the vacuum wiper 172*c* has formed thereon a suction opening connected to a suction pump (not shown). Moving the carriage 172*b* in the y-direction while activating the suction pump makes it possible to suck, into the suction opening, ink and the like adhering to the ejection opening surface 8*a* of the print head 8, while wiping and gathering the ink and the like by the vacuum wiper 172*c*.

Figure 9:
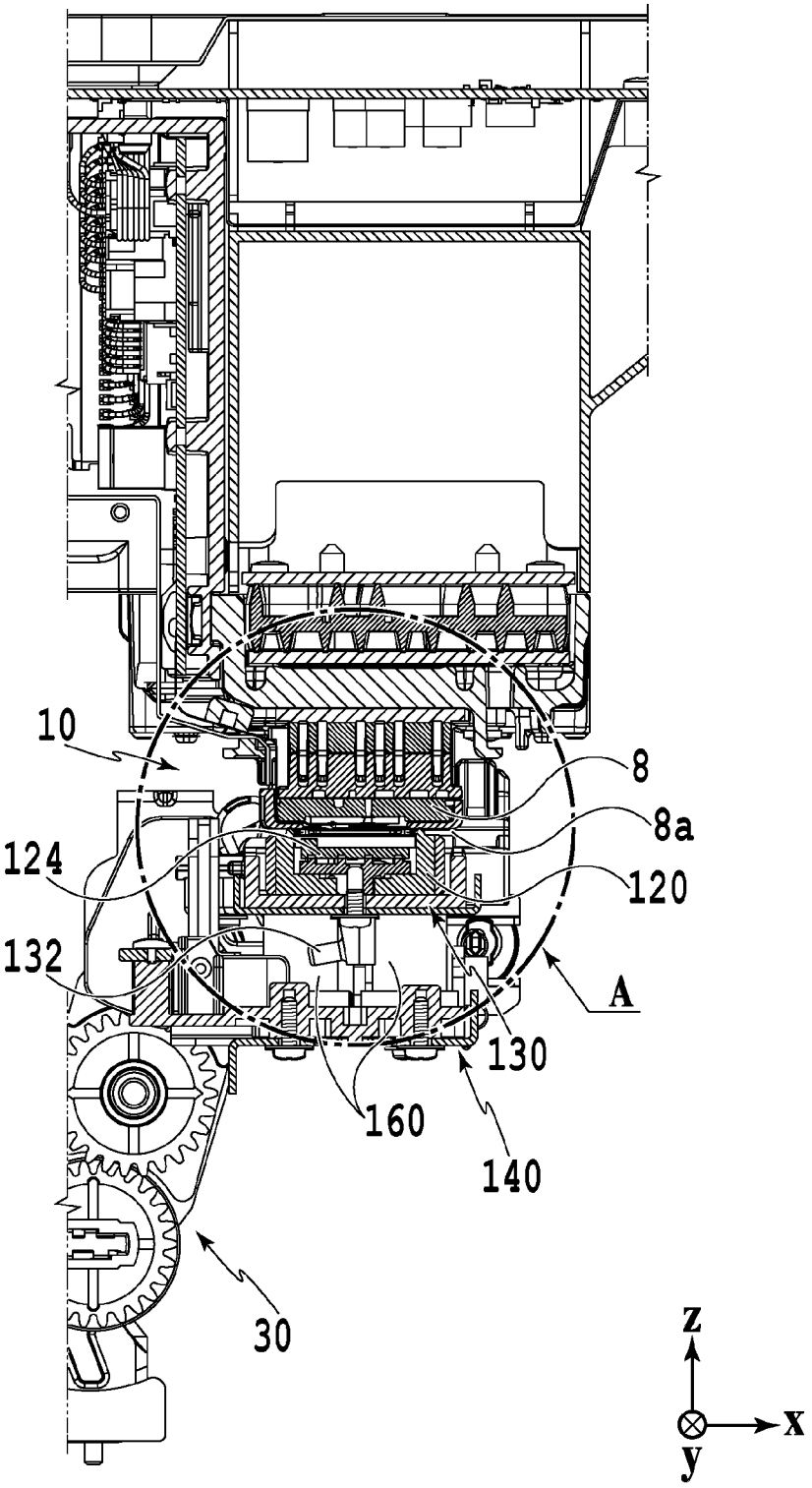
FIG. 9 is a cross-sectional view taken along line IX-IX of FIG. 1.
Figure 10:
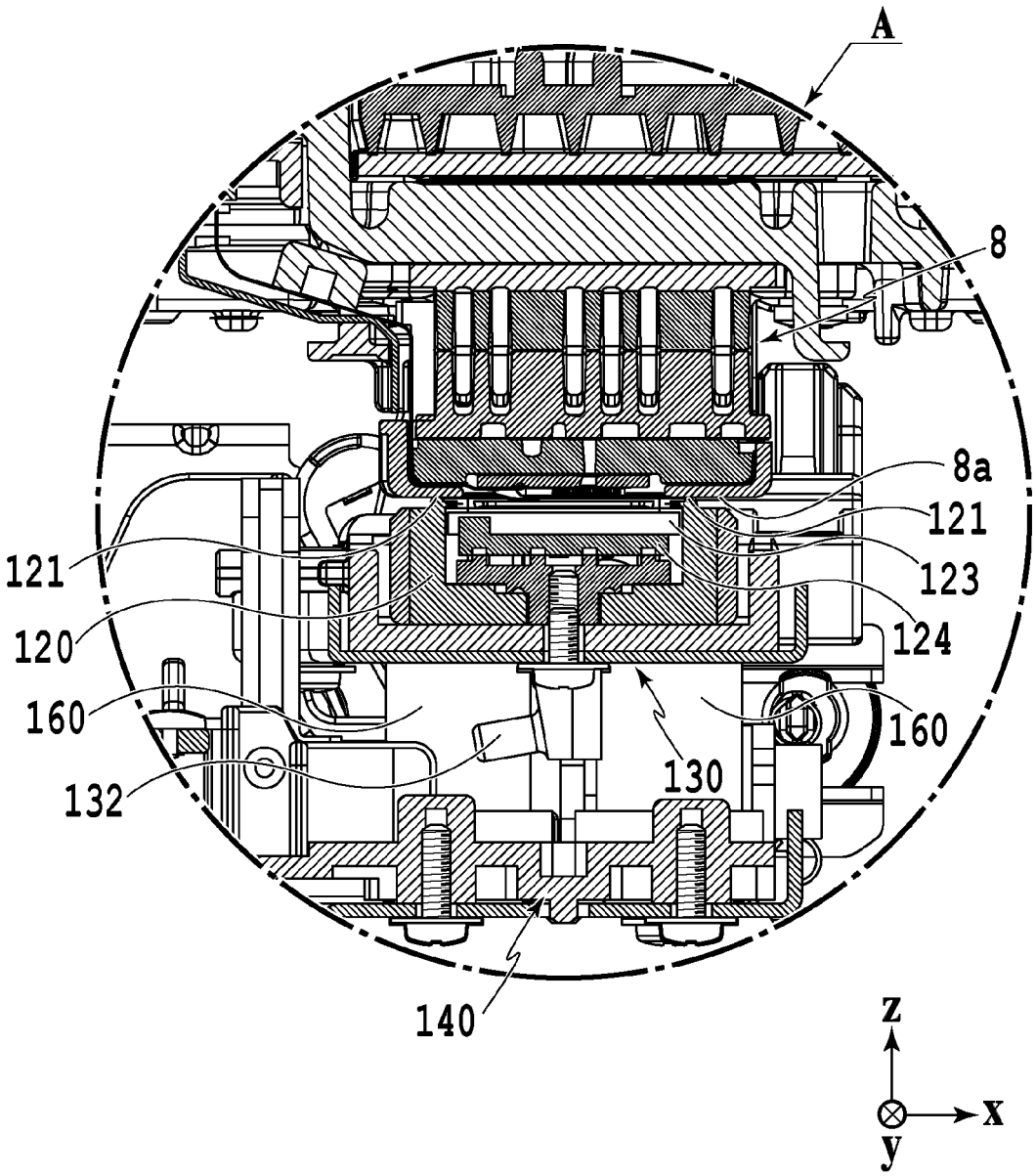
FIG. 10 is an enlarged view of the part A of FIG. 9.

Next, the cap unit 10 in the present embodiment will be described in detail. FIG. 9, which is a cross-sectional view showing a configuration of the cap unit 10 and the print head 8, shows a cross-section taken along the line IX-IX of FIG. 1. In addition, FIG. 10 is an enlarged view of the part A of FIG. 9. Note that FIGS. 9 and 10 show a state in which the cap member 120 of the cap unit 10 contacts the ejection opening surface 8*a* of the print head 8.

In FIGS. 9 and 10, the cap unit 10 is configured in a manner including a cap base unit 140, a cap holder unit 130, the cap member 120, a cap spring 160, and the like.

The cap base unit 140 is held ascendibly and descendibly by an ascending and descending mechanism 30 provided in the maintenance unit 16. The ascending and descending mechanism 30 includes a motor (not shown) whose drive is controlled by the print controller 202 of the print engine unit 200 (FIG. 2), and a power conversion mechanism configured to convert the driving force of the motor into an ascending and descending operation of the cap base plate 141.

The cap holder unit 130 is supported on the cap base unit 140 via the cap spring 160, and the cap member 120 is fixed to the interior of the cap holder unit 130. The cap member 120 is formed with an elastic member (for example, elastomer such as rubber) into the shape of a generally rectangular parallelepiped box, inside which an ink absorber 123 (see FIG. 10) is fixed via an absorber holding member 124. In addition, contacting part 121 capable of contacting the ejection opening surface 8*a* of the print head 8 at a standby position is integrally formed in an opening formed on the upper end of the cap member 120.

The contacting part 121 has a generally rectangular planar shape along the opening of the cap member 120, as shown in FIG. 8. Causing the contacting part 121 of the cap member 120 to contact the ejection opening surface 8*a* of the print head at the standby position causes the ejection opening to be capped. As thus described, capping the print head 8 by the cap member 120 allows for protecting the ejection opening, as well as mitigating increase of viscosity or solidification of ink due to evaporation of ink solvent from the ejection openings.

In addition, the lower surface of the cap holder unit 130 has connected thereto a waste ink flow path 20 (see FIG. 11) in communication with the interior of the cap member 120. Note that the waste ink flow path 20 includes joint 132 shown in FIG. 9 and a tubular member connected thereto.

Figure 11:
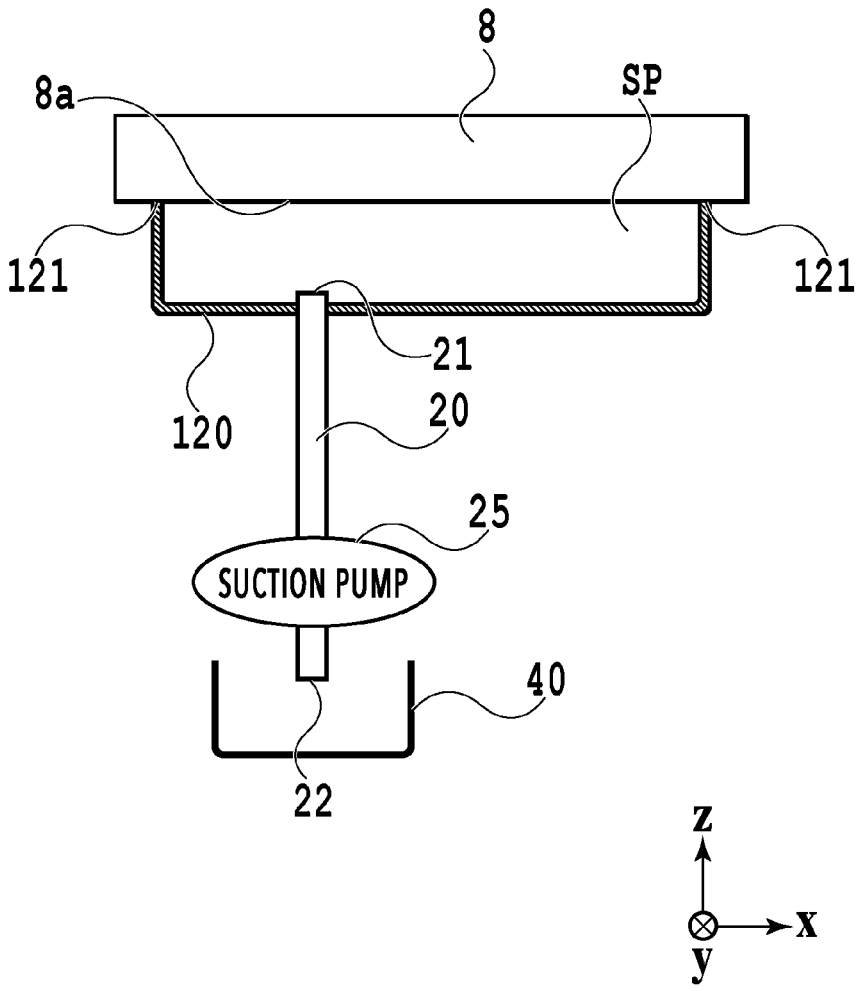
FIG. 11 schematically shows a cap member of a first embodiment and a configuration related thereto.

FIG. 11 schematically shows a recovery unit provided in the maintenance unit 16 described above. Note that FIG. 11 schematically shows only the cap member 120 in the cap unit 10 and a suction unit connected thereto.

As has been described above, the periphery of the opening of the cap member 120 has formed thereon the contacting part 121 capable to contact the ejection opening surface 8*a* of the print head 8. Forming an contacting state in which the contacting part 121 contacts the ejection opening surface 8*a* of the print head 8 in the standby position brings the cap member 120 into a state covering the ejection openings of the print head 8 (cap-closed state). FIG. 11 shows the cap-closed state.

The bottom of the cap member 120 has the waste ink flow path 20 connected thereto. The waste ink flow path 20 is a flow path for discharging, to the outside of the cap member 120, liquid (ink) and gas which have been discharged to the cap member 120. The waste ink flow path 20 has connected thereto the suction pump (negative pressure generation unit) 25 which forcibly causes fluid (ink and gas) to flow from a suction opening 21 toward a discharge opening 22 in a same flow path. The ink discharged from the discharge opening 22 of the waste ink flow path 20 is collected into an ink collecting unit 40. Note that drive of the suction pump 25 is controlled by the print controller 202 serving as a control unit, via the maintenance control unit 210.

In the printing apparatus 1 configured as described above, the cap member 120 is in a cap-closed state contacting the ejection opening surface 8*a* of the print head 8 so as to cover the ejection openings, in the standby state in which a series of print operations has been finished, or a state in which all of the operations of the printing apparatus have been appropriately finished. In the cap-closed state, the cap member 120 and the print head 8 may be firmly fixed to each other in the case where there is increase of viscosity or solidification of ink which has adhered between the contacting part 121 of the cap member 120 and the ejection opening surface 8*a* of the print head 8. Such a firmly fixed state become particularly firm in the case where the cap-closed state holds for a long period.

In the case where the contacting part 121 of the cap member 120 and the ejection opening surface 8*a* of the print head 8 are firmly fixed to each other, there is a possibility that the print head 8 may not be separated from the cap member 120 even in the case where the head movement mechanism is driven under an instruction to open the cap. Accordingly, in the present embodiment, a process shown in FIG. 12 is performed in the case where cap-separation instruction (cap-open instruction) is issued in the cap-closed state.

Figure 12:
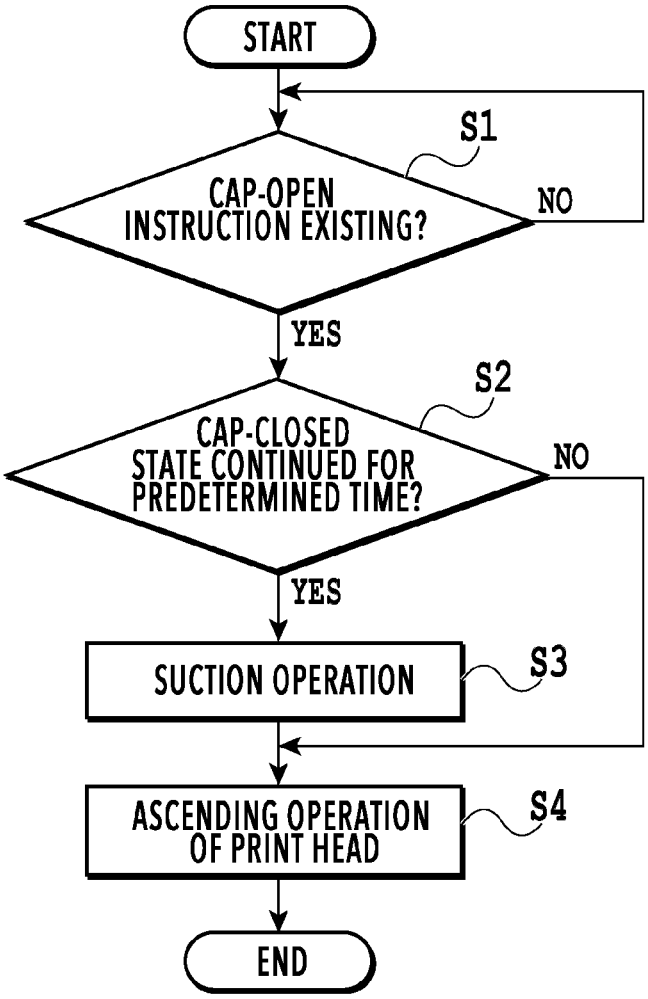
FIG. 12 is a flowchart showing cap-open operation of the first embodiment.

FIG. 12 is a flowchart showing cap-open operation that separates the print head 8 and the cap member 120, from the cap-closed state in which the contacting part 121 of the cap member 120 is contacting the ejection opening surface 8*a* of the print head 8.

The cap-open operation shown in FIG. 12 is performed by performing each step shown in the flowchart of FIG. 12 by the print controller 202 of the print engine unit 200 (see FIG. 2). Note that "S" indicated in FIG. 12 refers to steps performed in the flowchart.

Upon a separation instruction (cap-open instruction) for separating the print head 8 from the cap member 120 being input from the main controller 101, the print controller 202 determines whether or not the cap-closed state has continued for a predetermined time or longer (S1, S2). In the case where the cap-closed state has continued for a predetermined time or longer, the print controller 202 determines that there is a risk that the ejection opening surface 8*a* of the print head 8 and the contacting part 121 of the cap member 120 are firmly fixed to each other. In other words, the print controller 202 functions as a firmly-fixed state determination unit of the present invention. Subsequently, the print controller 202 drives the suction pump 25 (S3). Driving the suction pump 25 causes air and ink within a space SP surrounded by the cap member 120 and the print head 8 to be sucked into the waste ink flow path 20, thereby bringing the interior of the space SP into a negative pressure state.

Figure 13C:
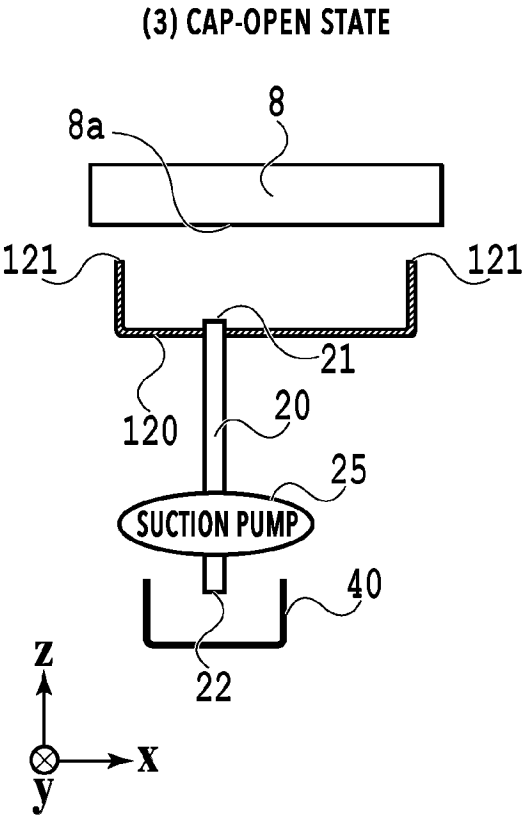
FIGS. 13A to 13C are a flowchart showing operation of the cap member of the first embodiment.
Figure 13B:
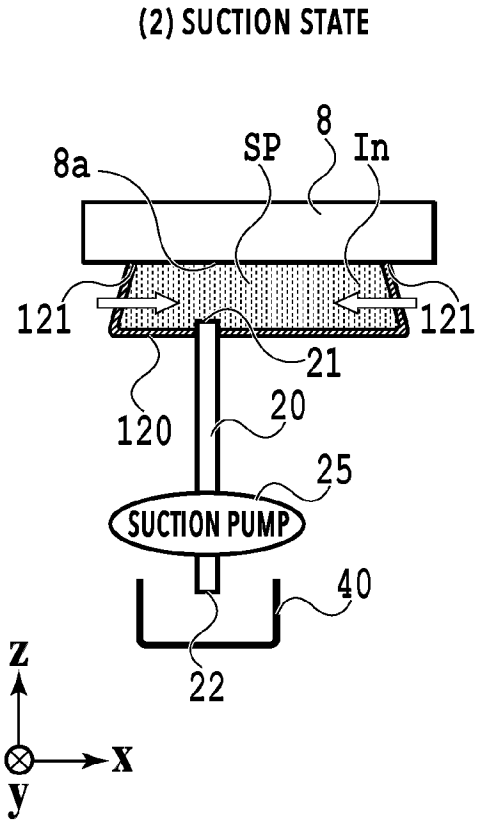
Figure 13A:
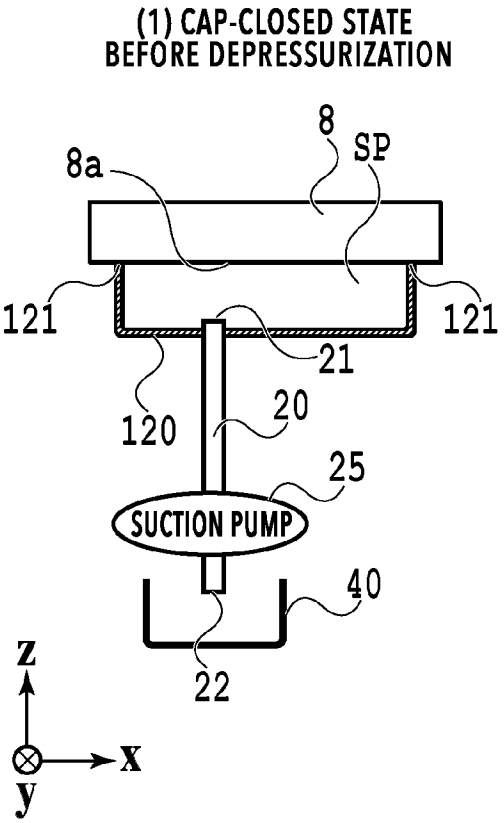

FIG. 13A shows the cap-closed state before suction operation is performed, and FIG. 13B shows the state after the suction operation has been performed. Turning the interior of the space SP into a negative pressure state by the suction operation of the suction pump 25 causes the contacting part 121 of the cap member 120 to be pulled, and elastically deform, in a direction in which the volume of the space SP decreases, whereby the contacting position against the ejection opening surface 8*a* moves. In addition, bringing the interior of the space into a negative pressure state by the suction operation of the suction pump 25 causes ink to be forcibly discharged from the ejection openings of the print head 8. The discharged ink In accumulates inside the cap member 120, and the ink In reaches the contacting position between the ejection opening surface 8*a* of the print head 8 and the contacting part 121 of the cap member 120. Although a part of ink In discharged into the cap member 120 is absorbed by the ink absorber 123, the amount of ink discharged by the sucking exceeds the ink reception capacity of the ink absorber 123, and therefore the level of the ink In reaches the contacting position between the ejection opening surface 8*a* and the contacting part 121. Accordingly, the ink firmly fixing the ejection opening surface 8*a* and the contacting part 121 is dissolved by the ink discharged from the print head 8, thereby reducing the force firmly fixing the ejection opening surface 8*a* and the contacting part 121.

As thus described, performing the suction operation by the suction pump 25 causes the contacting part 121 to move, and the ink solidified between the ejection opening surface 8*a* and the contacting part 121 to be dissolved, thereby resolving the firmly-fixed state between the ejection opening surface 8*a* of the print head 8 and the contacting part 121.

Subsequently, the print controller 202 separates the print head 8 by the head movement mechanism via the head carriage control unit 20 (FIG. 13C). The firmly-fixed state between the cap member 120 and the print head 8 has been resolved, and therefore the print head 8 smoothly separates. Note that separating the cap member 120 from the ejection opening surface 8*a* of the print head 8 causes the cap member 120 to return to its original state from the elastically deformed state due to its own elastic force, as shown in FIG. 13C.

Additionally, in the case where it is determined at S2 that the cap-closed state is within a predetermined time, the possibility that the cap member 120 and the print head 8 are firmly fixed is low, and therefore the print head 8 is moved in the vertically upward direction at S4 without performing the suction operation.

In the present embodiment as described above, it becomes possible to smoothly perform the separating operation between the print head 8 and the cap member 120, even in the case where the cap-closed state is continuing for a predetermined time or longer, and the cap member 120 and the print head 8 are firmly fixed to each other.

In the embodiment described above, there has been shown a configuration in which the interior of the cap is brought into a negative pressure state in the case where the cap-closed state is continuing for a predetermined time or longer. For example, at the time of power-on, there is a high possibility that the cap-closed state is continuing for a long time and the cap member 120 and the print head 8 are in a firmly-fixed state. Accordingly, there may be a configuration such that the suction operation S3 is performed under a cap-open instruction without performing determination at S2.

Second Embodiment

Figure 14:
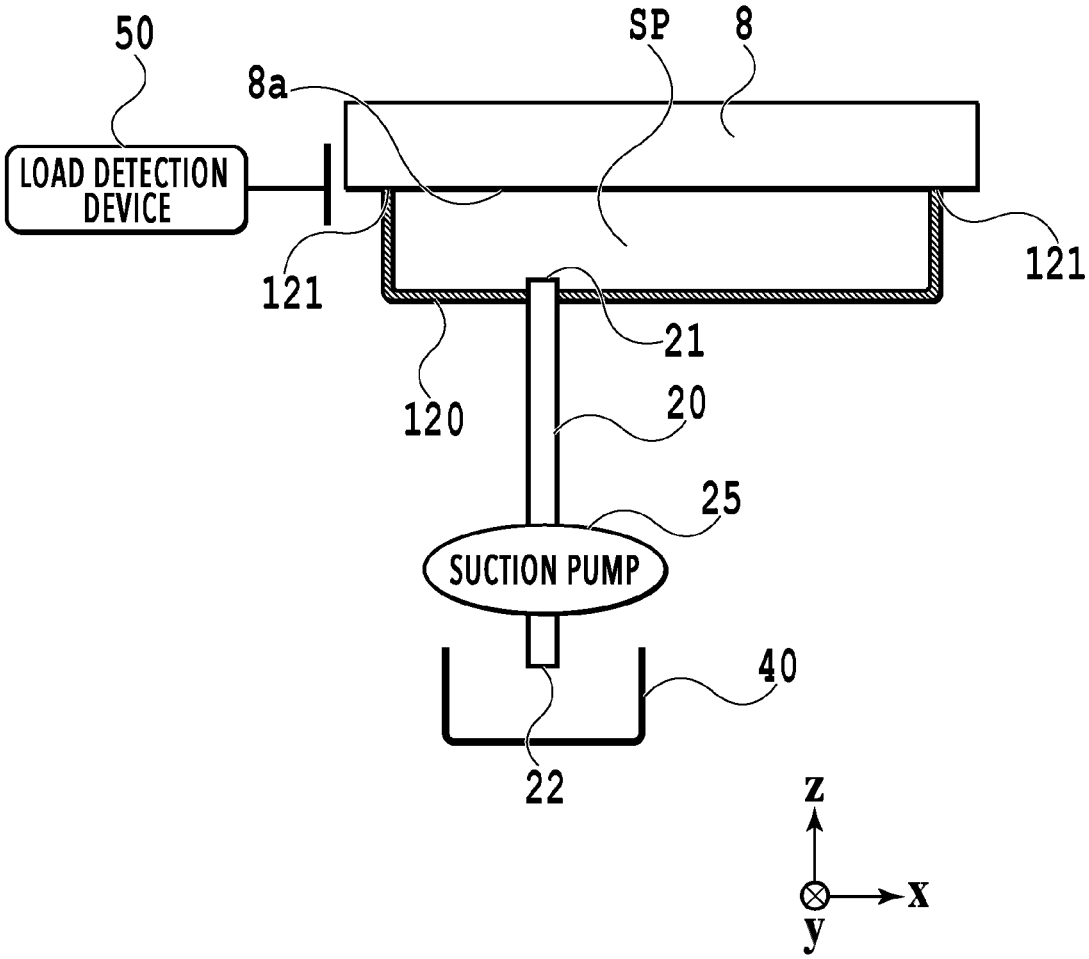
FIG. 14 schematically shows a cap member and a configuration related thereto.

Next, a second embodiment of the present invention will be described, referring to FIGS. 14 and 15.

The second embodiment includes a load detecting unit 50 configured to detect the drive load of the drive motor of the head movement mechanism. The load detecting unit 50 is configured to detect a PWM (pulse width modulation) value that varies in accordance with the drive load of the drive motor of the head movement mechanism.

Figure 15:
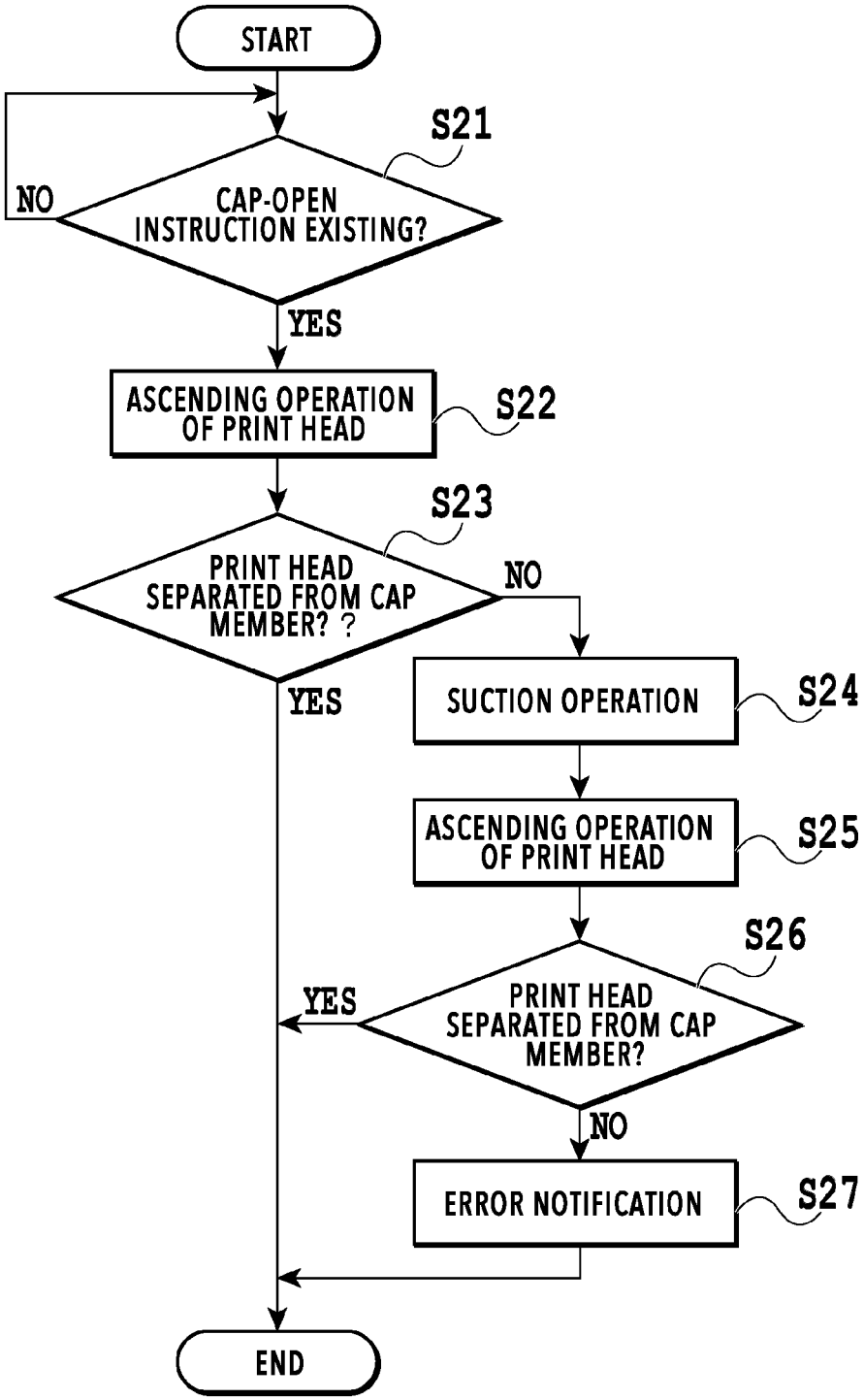
FIG. 15 is a flowchart showing cap-open operation of a second embodiment.

FIG. 15 is a flowchart showing cap-open operation of the second embodiment.

In the case where a cap-open instruction is output from the main controller 101, the print controller 202 performs operation of separating the print head 8 by the head movement mechanism (S21, S22). Specifically, the drive motor of the head movement mechanism is driven to move the print head 8 contacting the cap member 120 upward in the vertical direction.

The print controller 202 determines whether or not the print head 8 is separated from the cap member 120, based on whether or not the detection value of the load detecting unit 50 (PWM value of the drive motor) is equal to or larger than a predetermined threshold value (S23). Specifically, in the case where the PWM value of the drive motor is smaller than the predetermined threshold value, the print controller 202 determines that the print head 8 is separated from the cap member 120, and terminates the cap-open process.

On the other hand, in the case where the PWM value of the drive motor is equal to or larger than the predetermined threshold value according to the load detecting unit 50, the print controller 202 determines that the print head 8 has not separated from the cap member 120. In other words, it is determined that the firmly-fixed state between the print head 8 and the cap member 120 has not been resolved by driving the drive motor of the head movement mechanism, and the drive motor is terminated and the process flow proceeds to S24.

At S24, the suction pump 25 connected to the cap member 120 performs suction operation, thereby bringing the interior of the space SP surrounded by the cap member 120 and the print head 8 into a negative pressure state. The firmly-fixed state between the print head 8 and the cap member 120 is resolved by bringing the cap member 120 into the state shown in FIG. 13B by the suction operation.

Subsequently, the print controller 202 drives the drive motor of the head movement mechanism, and performs ascending operation of the print head 8 (S25). In addition, the print controller 202 determines whether or not the print head 8 and the cap member 120 are separated from each other, based on the detection result of the load detecting unit 50 (S26). In the case where it is determined that the print head 8 and the cap member 120 are separated from each other, it is regarded that the cap-opening state is obtained, and the cap-open process is terminated.

Additionally, in the case where it is determined at S26 that the print head 8 and the cap member 120 have not separated from each other, error notification is performed (S27), regarding that the cap member 120 and the print head 8 are firmly fixed to each other and it is impossible to resolve the firmly-fixed state at S24.

It is also possible in the second embodiment, as described above, to resolve the firmly-fixed state between the cap member 120 and the print head 8 by the suction operation at S24, and therefore it becomes possible to reliably perform the cap-open operation. In addition, suction operation is performed only in the case where the print head 8 does not separate from the cap member 120 at S26, and therefore it becomes possible to avoid useless suction operation. Accordingly, it becomes possible to shorten the time required for suction operation, thereby mitigating the drop of throughput.

Furthermore, in the present embodiment, it is determined whether or not the cap member 120 and the print head 8 are separated from each other, based on the PWM value of the drive motor of the head movement mechanism. Accordingly, it becomes possible to determine more clearly whether or not the cap member 120 and the print head 8 are in a firmly-fixed state.

Third Embodiment

In the following, a third embodiment of the present invention will be described, referring to FIGS. 16 and 17.

Figure 16:
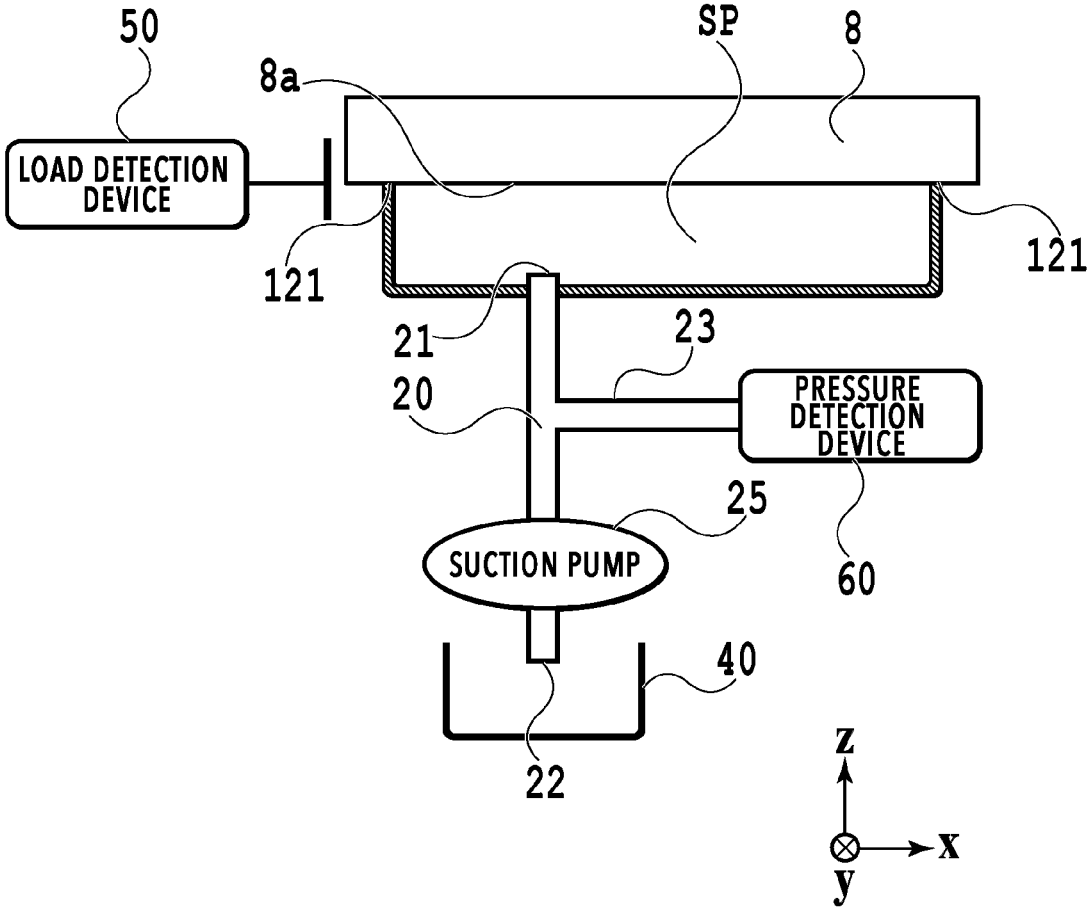
FIG. 16 schematically shows a cap member of a third embodiment and a configuration related thereto.

The third embodiment has a configuration in which a pressure detecting unit 60 is connected to the waste ink flow path 20 that leads to the suction pump 25 from the suction opening 21 in the waste ink flow path 20 via a branch flow path 23, as shown in FIG. 16. The pressure detecting unit 60 is intended to detect pressure inside the waste ink flow path 20 located upstream (the side of the cap member 120) of the suction pump 25.

Figure 17:
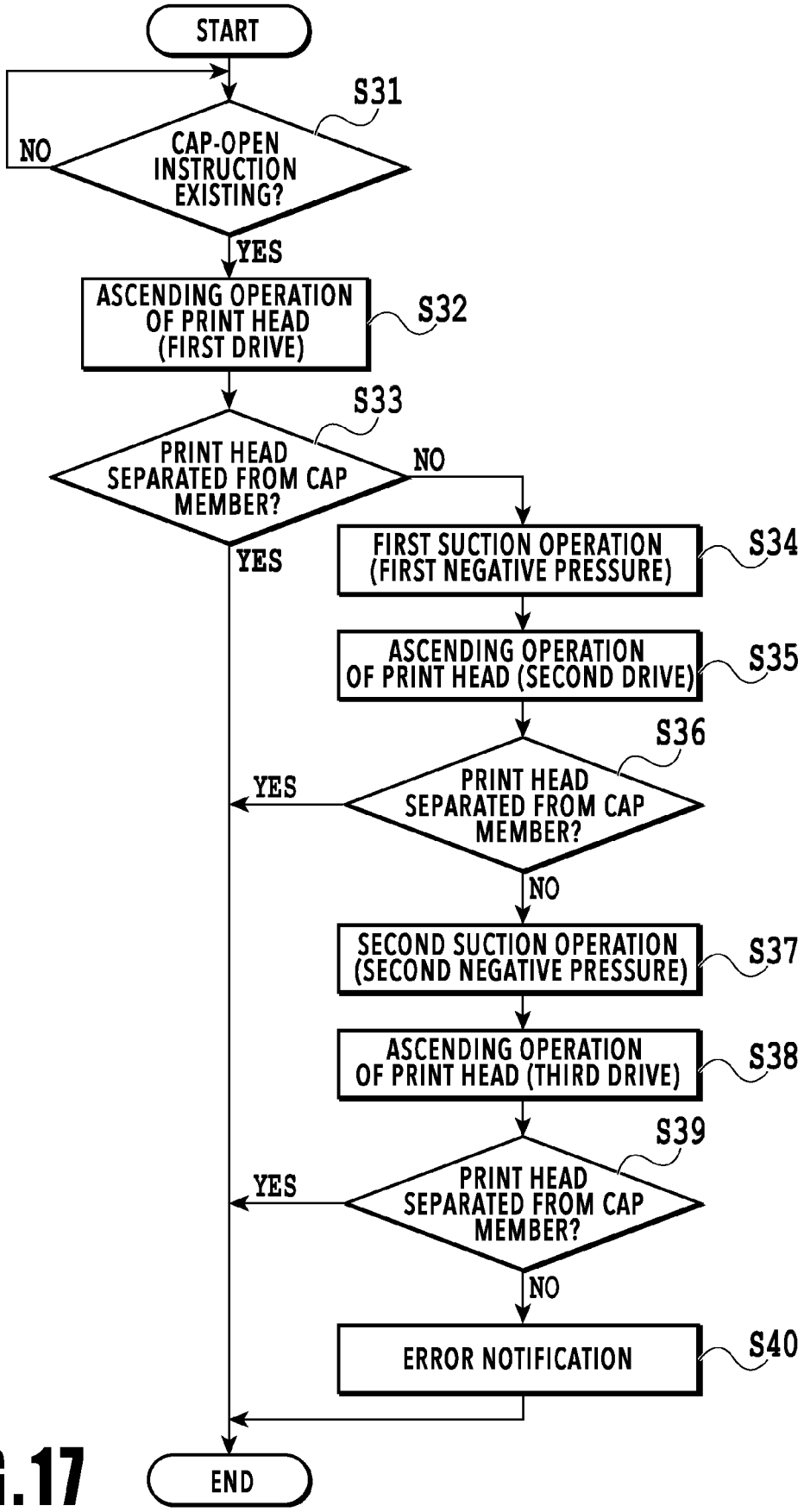
FIG. 17 is a flowchart showing cap-open operation of the third embodiment.

FIG. 17 is a flowchart showing cap-open operation of the third embodiment.

At S31 to S36 shown in FIG. 17, processes generally similar to S21 to S26 of the second embodiment are performed. In other words, in the case where a cap-open instruction is input, the print controller 202 drives the drive motor of the head movement mechanism (first drive), and performs ascending operation that separates the print head 8 from the cap member 120 (S31, S32).

At S33, it is determined whether or not the print head 8 is separated from the cap member 120 based on the detection result of the load detecting unit 50 (PWM value of the drive motor) and, in the case where it is determined that the print head 8 is separated from the cap member 120, the cap-opening process is terminated.

Additionally, in the case where it is determined at S33 that the print head 8 has not separated from the cap member 120, the first suction operation is performed by the suction pump 25 at S24, thereby bringing the interior of the space SP surrounded by the cap member 120 and the print head 8 into a negative pressure state. In the present embodiment, pressure inside the waste ink flow path 20 is detected based on the pressure detecting unit 60, and the first suction operation is performed until a predetermined negative pressure (first negative pressure) is detected.

Subsequently, the print controller 202 drives the drive motor of the head movement mechanism (second drive), and performs ascending operation of the print head 8 (S35). Here, the print controller 202 determines whether or not the print head 8 and the cap member 120 are separated from each other, based on the detection result of the load detecting unit 50 (PWM value of the drive motor) (S36). In the case where it is determined that the print head 8 and the cap member 120 are in a separated state, it is regarded that the cap-opening state has been obtained, and the cap-opening process is terminated.

On the other hand, in the case where it is determined at S36 that the print head 8 and the cap member 120 have not separated from each other, the second suction operation is performed (S37). The second suction operation is performed until the negative pressure inside the space SP reaches a second negative pressure. The second negative pressure is a negative pressure whose absolute value is larger than that of the first negative pressure, and therefore the cap member 120 is deformed inward by a stronger power in the second suction operation.

After the second suction operation, the print controller 202 drives the drive motor of the head movement mechanism again (third drive), and performs ascending operation of the print head 8 (S38). Here, the print controller 202 determines whether or not the print head 8 and the cap member 120 are separated from each other, based on the detection result of the load detecting unit 50 (PWM value) (S39). In the case where it is determined that the print head 8 and the cap member 120 are in a separated state, the print controller 202 regards that the cap-opening state is obtained, and terminates the cap-opening process. In addition, error notification is performed in the case where it is determined at S39 that the print head 8 and the cap member 120 are not separated (S40).

In the present embodiment, as has been described above, in the case where the firmly-fixed state between the print head and the cap member is not resolved by performing the first suction operation to generate a relatively low negative pressure, the second suction operation is performed to generate a higher negative pressure. According thereto, it becomes possible to perform suction operation in accordance with the degree of the firmly-fixed state (strength of fixing force) between the print head and the cap member, whereby it is possible to more reliably separate the cap member and the print head and reduce the waste of performing excessive suction operation.

Another Embodiment

In the aforementioned embodiment, a configuration has been shown in which driving the drive motor of the head movement mechanism causes the print head 8 and the cap member 120 to contact and separate from each other. However, it is also possible to perform contacting and separation of the print head 8 and the cap member 120 by the drive motor of the ascending and descending mechanism 30 configured to cause the cap member 120 to ascend and descend.

In addition, although the aforementioned embodiment has been described, taking a full line type printing apparatus as an example, the present invention is also applicable to a so-called serial type printing apparatus configured to perform printing by causing the print head to scan in a direction intersecting with the conveying direction of the print medium. In such a case, contacting or separation between the print head and the cap member may also be performed by driving the drive motor of the scanning unit configured to move the print head in the main scan direction.

In the foregoing, although the present invention has been described with regard to an example applied to an inkjet printing apparatus, the present invention is also applicable to a liquid ejection apparatus configured to eject liquid other than ink, and a recovery unit used therefor. In other words, the present invention is applicable to any configuration that brings a cap member receiving liquid discharged from a liquid ejection unit configured to eject liquid other than ink into intimate contact with, or separation from, an ejection opening surface of a print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-054638 filed Mar. 22, 2018, which is hereby incorporated by reference wherein in its entirety.

What is claimed is:

1. A liquid ejection apparatus comprising:

a liquid ejection unit having an ejection opening surface with an ejection opening for ejecting liquid formed thereon;

a cap member configured to contact the ejection opening surface and cover the ejection opening surface;

a drive motor configured to bring the liquid ejection unit and the cap member into contact with or separation from each other;

a load detecting unit configured to detect a drive load of the drive motor;

a negative pressure generation unit configured to bring a space surrounded by the ejection opening surface and the cap member into a negative pressure state; and a control unit configured to receive a separation instruction to separate the cap member and the liquid ejection unit, drive the negative pressure generation unit, and drive the drive motor, wherein, when the drive load at the time of driving the drive motor under the separation instruction is equal to or larger than a predetermined drive load, the control unit causes the negative pressure generation unit to bring the space into a negative pressure state and subsequently causes the drive motor to separate the liquid ejection unit and the cap member, and wherein, when the drive load at the time of driving the drive motor under the separation instruction is less than the predetermined drive load, the control unit does not drive the negative pressure generation unit and causes the drive motor to separate the liquid ejection unit and the cap member.

2. The liquid ejection apparatus according to claim 1, wherein the control unit receives the separation instruction at a time when the liquid ejection apparatus is powered on and causes the drive motor to drive under the separation instruction.

3. The liquid ejection apparatus according to claim 1, wherein when the separation instruction is received and a contacting state between the cap member and the liquid ejection unit continues for a predetermined time or longer, the control unit drives the negative pressure generation unit to bring the space into a negative pressure state, and subsequently causes the drive motor to separate the liquid ejection unit and the cap member.

4. The liquid ejection apparatus according to claim 1, wherein, when the drive load of the drive motor at the time of driving the drive motor after having brought the space into a first negative pressure state is equal to or larger than the predetermined drive load, the control unit drives the negative pressure generation unit to generate a second negative pressure which is larger than the first negative pressure, and subsequently separates the liquid ejection unit and the cap member.

5. The liquid ejection apparatus according to claim 4, further comprising a pressure detection unit configured to detect a pressure of the space, wherein the control unit controls the negative pressure generation unit to generate the first and the second negative pressures based on a detection result of the pressure detection unit.

6. The liquid ejection apparatus according to claim 1, wherein the load detecting unit detects a drive load of the drive motor based on a PWM value, which is a value indicating a ratio between the driving and not driving the drive motor.

7. A control method for a liquid ejection apparatus that includes a liquid ejection unit having an ejection opening surface with an ejection opening for ejecting liquid formed thereon, a cap member contacting the ejection opening surface and covering the ejection opening surface, and a drive motor configured to bring the liquid ejection unit and the cap member into contact with or separation from each other, the method comprising:

driving the drive motor to separate the liquid ejection unit and the cap member under a separation instruction to separate the cap member and the liquid ejection unit; and detecting a drive load of the drive motor, wherein, when the drive load at the time of driving the drive motor under the separation instruction is equal to or larger than a predetermined drive load, the drive motor is driven to separate the liquid ejection unit and the cap member a space surrounded by the ejection opening surface and the cap member has been brought into a negative pressure state by driving a negative pressure generation unit, and wherein, when the drive load at the time of driving the drive motor under the separation instruction is less than the predetermined drive load, the drive motor is driven to separate the liquid ejection unit and the cap member without driving the negative pressure generation unit to bring the space into a negative pressure state.

8. The control method according to claim 7, wherein the drive motor is driven under the separation instruction at a time when the liquid ejection apparatus is powered on.

9. The control method according to claim 7, further comprising driving the negative pressure generation unit to bring the space into a negative pressure state, when the separation instruction is received and a contacting state between the cap member and the liquid ejection unit continues for a predetermined time or longer, and subsequently driving the drive motor to separate the liquid ejection unit and the cap member.

10. The control method according to claim 7, wherein, when the drive load of the drive motor at the time of driving the drive motor after having brought the space into a first negative pressure state is equal to or larger than the predetermined drive load, the negative pressure generation unit is further driven to generate a second negative pressure which is larger than the first negative pressure, and subsequently the drive motor is driven to separate the liquid ejection unit and the cap member.

11. The control method according to claim 10, wherein the first and the second negative pressures are generated based on a detection result of a pressure detection unit configured to detect a pressure of the space.

12. The control method according to claim 7, wherein the drive load of the drive motor is detected based on a PWM value, which is a value indicating a ratio between the driving and not driving the drive motor.

13. A liquid ejection apparatus comprising:

a liquid ejection unit having an ejection opening surface with an ejection opening for ejecting liquid formed thereon;

a cap member configured to contact the ejection opening surface and cover the ejection opening surface;

a drive motor configured to bring the liquid ejection unit and the cap member into contact with or separation from each other;

a negative pressure generation unit configured to bring a space surrounded by the ejection opening surface and the cap member into a negative pressure state; and a control unit configured to drive, when a separation instruction to separate the cap member and the liquid ejection unit is received and a contacting state between the cap member and the liquid ejection unit is continues for a predetermined time or longer, the negative pressure generation unit to bring the space into a negative pressure state and subsequently drives the drive motor to separate the liquid ejection unit and the cap member.

14. A liquid ejection apparatus comprising:

a liquid ejection unit having an ejection opening surface with an ejection opening for ejecting liquid formed thereon;

a cap member configured to contact the ejection opening surface and cover the ejection opening surface;

a drive motor configured to bring the liquid ejection unit and the cap member into contact with or separation from each other;

a negative pressure generation unit configured to bring a space surrounded by the ejection opening surface and the cap member into a negative pressure state; and a control unit configured to receive a separation instruction to separate the cap member and the liquid ejection unit, drive the negative pressure generation unit, and drive the drive motor, wherein, when the liquid ejection unit and the cap member are not separated, the control unit drives the negative pressure generation unit to bring the space into a negative pressure state and subsequently drives the drive motor to separate the liquid ejection unit and the cap member under the separation instruction, and wherein, when the liquid ejection unit and the cap are separated, the control unit does not drive the negative pressure generation unit and causes the drive motor to separate the liquid ejection unit and the cap member under the separation instruction.

15. The liquid ejection apparatus according to claim 14, wherein the control unit receives the separation instruction at a time when the liquid ejection apparatus is powered on and causes the drive motor to drive under the separation instruction.

* * * * *